US007165505B2

(12) United States Patent
Franchetti

(10) Patent No.: US 7,165,505 B2
(45) Date of Patent: Jan. 23, 2007

(54) INTEGRATED ACCESSORY FOR AN INFLATABLE APPARATUS

(75) Inventor: Bernard Franchetti, Le Vernet (FR)

(73) Assignee: Zodiac International, Issy les Moulineaux (FR)

( * ) Notice: Subject to any disclaimer, the term of this patent is extended or adjusted under 35 U.S.C. 154(b) by 0 days.

(21) Appl. No.: 10/725,875

(22) Filed: Dec. 1, 2003

(65) Prior Publication Data

US 2004/0137808 A1 Jul. 15, 2004

(30) Foreign Application Priority Data

Dec. 2, 2002 (FR) ..... 02 15138
Feb. 4, 2003 (FR) ..... 03 01251

(51) Int. Cl.
*B63B 7/08* (2006.01)
*B63C 9/02* (2006.01)
*E04H 4/04* (2006.01)

(52) U.S. Cl. ..... 114/345; 441/40; 4/496; 4/585

(58) Field of Classification Search ..... 114/345; 441/30, 40–46, 66, 125–133, 135; 4/488–513, 4/588; 5/655.3, 681, 706–715
See application file for complete search history.

(56) References Cited

U.S. PATENT DOCUMENTS 586,752 A * 7/1897 Fitz et al. ..... 251/357
919,358 A * 4/1909 Jeffery ..... 152/397
1,765,002 A * 6/1930 Boyle et al. ..... 440/109
1,864,001 A * 6/1932 Spicer ..... 152/429
1,969,118 A * 8/1934 Brucker ..... 152/429
2,319,256 A * 5/1943 O'Hare ..... 4/404
3,780,768 A * 12/1973 Soderstrom ..... 137/625.48
3,843,027 A * 10/1974 Wilson et al. ..... 222/400.7
3,866,253 A * 2/1975 Sinks et al. ..... 405/186
3,903,915 A * 9/1975 Rosaz ..... 137/232
4,004,614 A * 1/1977 Mackal et al. ..... 138/89.2
4,478,587 A * 10/1984 Mackal ..... 441/41
4,669,498 A * 6/1987 Hansen ..... 137/223
4,720,281 A * 1/1988 Matsuoka ..... 405/186
4,864,961 A * 9/1989 Slonski ..... 114/360
6,074,261 A * 6/2000 Jougla ..... 441/41
6,080,027 A * 6/2000 Rodemann ..... 441/41
6,089,251 A * 7/2000 Pestel ..... 137/234.5
6,186,088 B1 * 2/2001 Garnier et al. ..... 114/345

FOREIGN PATENT DOCUMENTS

DE 2121903 A * 11/1972
DE 2352235 A * 4/1975

(Continued)

*Primary Examiner*—Ajay Vasudeva
(74) *Attorney, Agent, or Firm*—Dean W. Russell; Kilpatrick Stockton LLP

(57) ABSTRACT

Apparatus including an inflatable enclosure delimited by a flexible wall to which an accessory is secured. The wall has an opening defined by an edge to which a protruding reinforcement is secured; two rigid frames straddle the edge of the opening on each side of the wall, at least one frame including a groove accommodating the reinforcement; the two frames are clamped against one another, trapping the reinforcement in the groove; the accessory is secured to a frame; and the accessory mounted on the wall is leaktight with respect to the fluid used for inflating the enclosure.

24 Claims, 7 Drawing Sheets

FOREIGN PATENT DOCUMENTS

| | | | | |
|---|---|---|---|---|
| DE | 2404690 | A | * | 8/1975 |
| DE | 2411229 | | | 9/1975 |
| DE | 7117265 | | | 9/1975 |
| DE | 3436797 | A | * | 4/1986 |
| DE | 20214276 | | | 11/2002 |
| FR | 2259742 | | | 8/1975 |
| FR | 2379001 | A | * | 9/1978 |
| FR | 2483855 | A | * | 12/1981 |
| FR | 2627839 | A | * | 9/1989 |

* cited by examiner

FIG.9.
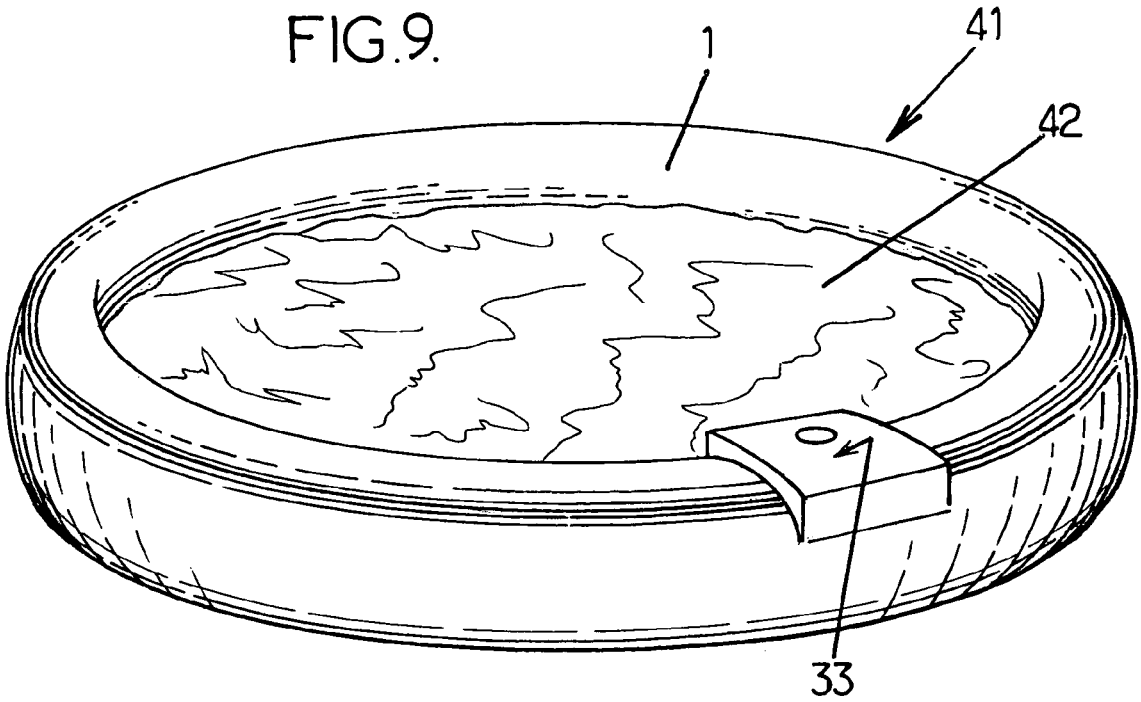
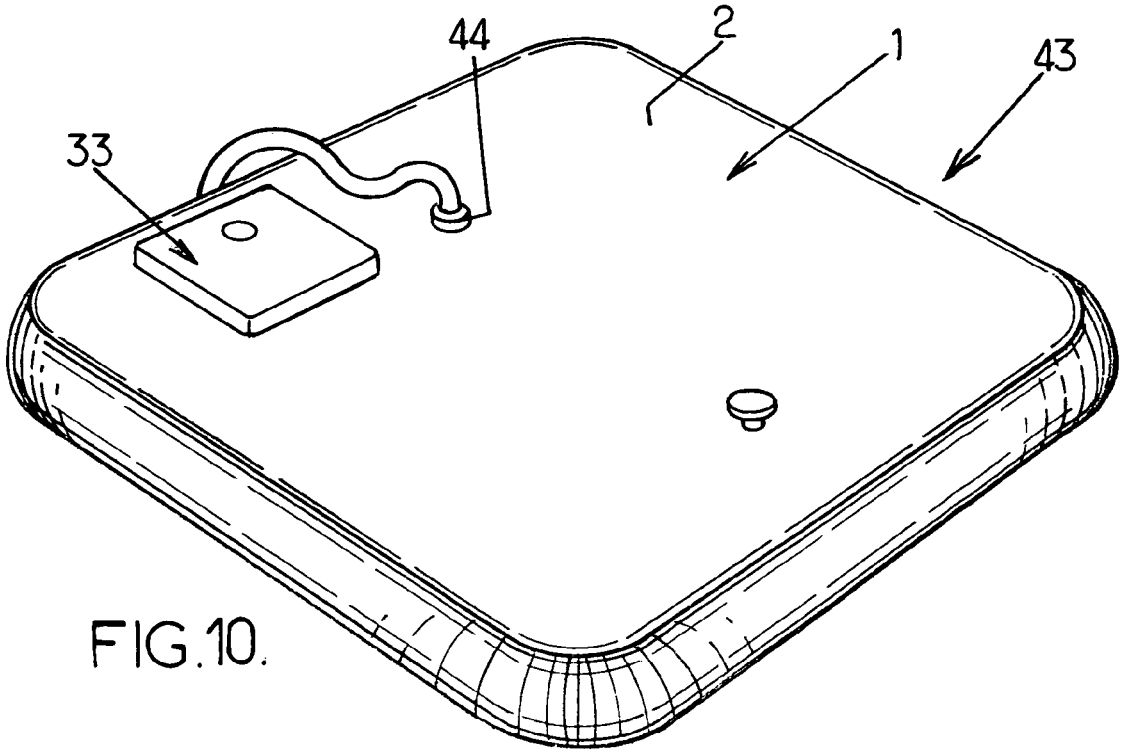
FIG.10.

INTEGRATED ACCESSORY FOR AN INFLATABLE APPARATUS

CROSS REFERENCE TO RELATED APPLICATIONS

This application claims priority to French Application No. 02 15138 filed on Dec. 2, 2002 and to French Patent Application No. 03 01251 filed on Feb. 4, 2003.

1. Field of the Invention

The present invention concerns improvements made to apparatuses formed by or comprising at least one inflatable enclosure delimited by at least one flexible wall and at least one accessory secured to said flexible wall of the enclosure.

The provisions of the invention can be applied in all types of apparatuses comprising at least one inflatable enclosure of whatever type. It appears, however, that their preferred application will be in pneumatically inflatable boats, irrespective of the specific form of these boats (flexible hull or rigid hull), and in inflatable swimming pools, irrespective of the configuration of the inflatable flank, it being understood that other types of apparatuses (for example pneumatically inflatable life rafts, flexible reservoirs for liquids, etc.) also come within the scope of application of the provisions of the invention.

2. Description of the Prior Art

It is customary to equip boats with various accessories such as handgrips, cleats, etc., designed to permit practical use of the boat (handgrips for pulling or carrying the boat, cleats for fastening of ropes: for mooring to a quay, mooring to another boat, securing a load, etc.). In the specific case of pneumatically inflatable boats, the accessories are attached to the wall of the inflatable enclosure and various techniques are known and used for fixing them; in general, the accessories have a base or widened foot which is secured (in particular by adhesive bonding or welding) to the wall of the inflatable enclosure. With this traditional type of arrangement and mounting, the accessory completely protrudes from the inflatable enclosure. Such protruding accessories, made of rigid and hard material, may prove dangerous when using the boat, even though their actual use is of relatively short duration. What is more, the permanent presence of these protruding accessories on the inflatable enclosure (which for its part is generally in the form of an elongate inflatable tube of highly profiled appearance) is not wholly acceptable from the aesthetic point of view.

Moreover, people using boats, and in particular pneumatically inflatable boats, wish to have various enclosed storage spaces available in which to keep equipment, food, documents, etc. Manufacturers of pneumatically inflatable boats, in seeking to respond to these expectations while at the same time avoiding floor-mounted compartments which take up a lot of space and are unattractive, have proposed various solutions for compartments integrated within structures of the boat: compartment arranged in the stem, compartment(s) in the steering console, compartment(s) in a suitably designed stern board, etc.

People using swimming pools may also wish to have a place available for keeping small accessories usable in the water (for example pool toys, a ball, etc.) and readily accessible from inside the swimming pool.

In the case of other apparatuses with a pneumatically or hydraulically inflatable enclosure for industrial use (for example flexible reservoirs for liquids, such as water, fuel, etc.), it may be useful for the apparatus itself to be provided with a space in which to store tools and/or control devices necessary for its operation and/or maintenance.

SUMMARY OF THE INVENTION

The object of the present invention is to respond to the wishes of the various users of the apparatuses in question in an original way, either replacing the existing solutions or complementing them, without this adding to the size of the apparatus or resulting in any substantial modification of the general infrastructures of the apparatus.

To these ends, the invention proposes an apparatus such as is mentioned in the preamble, which, being configured according to the invention, is characterized in that:

- the flexible wall of said inflatable enclosure has an opening defined by an edge, and a protruding reinforcement is secured to the edge of the opening on the circumference thereof,
- two substantially rigid frames are designed substantially corresponding with the abovementioned edge of the opening in order to straddle the latter and are each arranged on a respective side of the flexible wall (outer frame and inner frame respectively), at least one of these frames comprising a groove able to at least partially accommodate the abovementioned reinforcement,
- clamping means are attached to at least the two frames in order to clamp the two frames against one another, trapping said reinforcement in the groove,
- securing means secure the accessory to one of the frames, and
- leakproofing means ensure that the accessory mounted on the flexible wall is leaktight with respect to the fluid used for inflating the enclosure.

The means according to the invention are of great versatility and permit the mounting of numerous types of accessories, as will be explained below. These means are structurally simple and thus inexpensive to produce and install. The presence of the protruding reinforcement (bead) on the circumference of the opening, which reinforcement is engaged and retained in the groove provided in at least one of the frames, ensures the mechanical strength of the flexible wall about the entire circumference of the opening and in all directions, so that the shape and strength of the inflatable enclosure are not in any way affected by the presence of the opening: the functional combination of the peripheral protruding reinforcement and of the rigid frame equipped with a groove for receiving the reinforcement permits a particularly effective uptake of the tension forces to which the flexible wall tensioned by the inflating fluid is subjected.

As regards the leakproofing means intended to ensure leaktightness with respect to the inflating fluid (a gas, usually air), a simple and effective solution is one in which the leakproofing means comprise a flexible bag made of a leaktight material and secured in a leaktight manner to the inner face of the wall of the inflatable enclosure around the opening, said bag extending inside the inflatable enclosure and surrounding the abovementioned accessory in a leaktight manner.

The tension forces will be taken up still more effectively if the two frames comprise two respective grooves situated opposite one another and together defining a retaining channel able to accommodate said reinforcement.

In practice, the clamping means may advantageously be screws or bolts distributed about the circumference of the opening, although it is also possible to envisage (especially for fitting small accessories) that the wall bordering the opening, the inner frame and the outer frame are secured by adhesive bonding and/or welding.

The invention concerns in particular the mounting of accessories such as handgrips, cleats, or other devices of the same kind. To this end, a substantially rigid base is provided for mounting the accessory, which base extends at least partially inside the enclosure and is equipped with a peripheral shoulder constituting the abovementioned inner frame. In this case, the base can be provided substantially in the form of a plate, in which case the base will extend approximately in the plane of the flexible wall, and the accessory which is secured to it will protrude from said wall. However, in a very advantageous configuration, the base can also be provided in the form of an open box which then extends at least partially below the level of the flexible wall and inside the inflatable enclosure (recessed base): it then becomes possible for the accessory to be lodged in the box-shaped base, so that this accessory is at least partially recessed (recessed cleat, for example), or to be retractable (for example an extractable handgrip retained inside the base by springs).

In this context, it is possible for the accessory to comprise a functional part which is integral with the base, or for the accessory to comprise a functional part which is applied on the base and fixed thereto.

To improve the aesthetic appearance of the visible parts of the means used and/or to make said visible parts less conspicuous, it is advantageous if the outer frame is equipped with or covered on the outside with a decorative cap.

The means according to the invention make it possible to install, on the wall of the inflatable enclosure, an accessory of a rarely found type, namely a substantially rigid compartment which extends at least partially inside said inflatable enclosure and which comprises a substantially rigid shoulder protruding transversely with respect to the wall of the compartment and situated outside the wall of the enclosure.

This type of installation exploits the presence of the volume of the enclosure, for example the "empty" volume (that is to say the volume filled with air) of the pneumatically inflatable enclosure or enclosures (buoyancy tubes of a pneumatically inflatable boat, peripheral tube of an inflatable swimming pool or life raft, fillable volume of a flexible reservoir) with which the apparatus is equipped. This of course relatively large volume plays an important role in the functioning of the apparatus (in particular buoyancy in the case of a boat, water retention in the case of a swimming pool, and storage of a liquid in the case of a reservoir); in practice, however, the volume of the inflatable enclosure or enclosures is of a considerable dimension, particularly compared to what would be strictly necessary. The invention thus proposes appropriating a proportionally small part of this volume to give it a supplementary function of storage.

In a first possible embodiment, the shoulder of the compartment can constitute the abovementioned outer frame.

Preferably, however, in a second embodiment, the shoulder of the compartment is independent of the abovementioned outer frame and covers the latter; in this case, the shoulder of the compartment is fixed by the abovementioned clamping means, or, alternatively, the compartment is secured to only one of the two frames by second fixing means distinct from the abovementioned clamping means. In the latter case, the lateral wall of the compartment may advantageously have a ledge, and the second fixing means may comprise screws or bolts passing through said lateral wall of the compartment and engaged with one of the inner or outer frames, the heads of these screws or bolts bearing on a support piece resting against the abovementioned ledge; in particular, the support piece is unique and in the form of a frame matching the inner peripheral contour of the compartment in order to reinforce the latter. These provisions make it possible to produce a compartment which is mechanically strong and capable of supporting a considerable load, without a resulting risk of rupture at the level of the shoulder.

In one possible embodiment, the shoulder of the compartment, the inner frame and, optionally, the second, outer frame are substantially plane. However, if it is felt that such an arrangement does not integrate sufficiently into the general configuration, often at least partially curved, of the inflatable enclosure and/or is not especially attractive, a modified arrangement can then be provided in which the shoulder of the compartment, the inner frame and, optionally, the second, outer frame are curved substantially to match the curvature of the flexible wall of the inflatable enclosure.

Of course, the compartment will be able to be provided with all the means necessary for its function and for its environment; lid (removable, sliding or pivoting), lock, seal, etc. Likewise, the compartment can be given any desired shape, especially a parallelepiped, in particular an elongate rectangular parallelepiped, which integrates more easily into an enclosure of elongate shape such as a buoyancy tube of a boat or an edge of a swimming pool.

An accessory arrangement as defined above according to the invention can be integrated, as required, in numerous types of apparatuses provided with at least one inflatable enclosure with at least one flexible wall, irrespective of the nature (pneumatic, hydraulic) of the inflation of said enclosure. However, the invention relates more particularly (but not exclusively) to pneumatically inflatable apparatuses comprising a least one flank with at least one pneumatically inflatable tube, which are then formed as set out above, the abovementioned inflatable enclosure being formed here by said pneumatically inflatable tube which receives said accessory.

In particular, a more specific application within the scope of the present invention concerns the field of pneumatically inflatable boats: according to the invention, a pneumatically inflatable boat comprising two lateral floats joined at the front to form a stem and braced by a rigid floor and by a stern board, each lateral float being formed by at least one pneumatically inflatable tube, is characterized in that this inflatable tube is equipped with at least one accessory as set out above. Another preferred application also particularly coming within the scope of the invention concerns the field of inflatable swimming pools: according to the invention, a pneumatically inflatable swimming pool delimited circumferentially by at least one pneumatically inflatable tube is characterized in that this tube is equipped with at least one accessory as set out above.

BRIEF DESCRIPTION OF THE DRAWINGS

The invention will be better understood on reading the following detailed description of a number of preferred embodiments given solely as non-limiting examples. In this description, reference is made to the attached drawings, in which:

FIG. 9 is a diagrammatic perspective view of an inflatable swimming pool equipped according to the invention; and FIG. 10 is a diagrammatic perspective view of a flexible reservoir for liquid, equipped according to the invention.

DETAILED DESCRIPTION OF THE INVENTION

Figure 1:
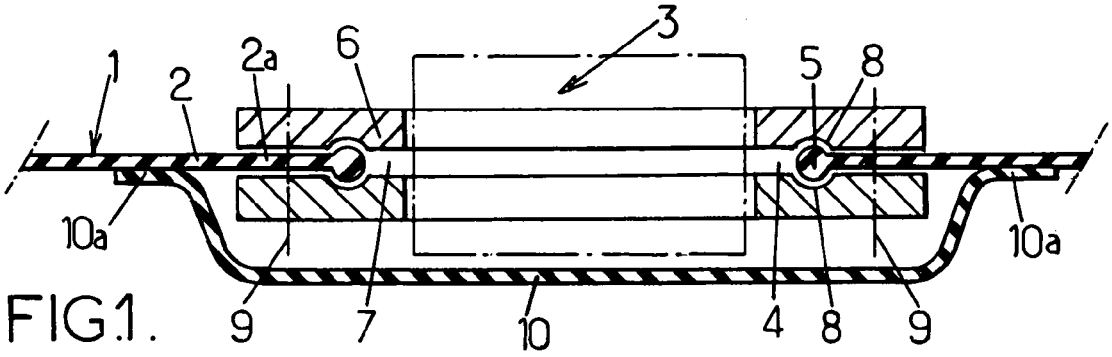
FIG. 1 is a diagrammatic and cross-sectional view of part of an inflatable apparatus designed according to the invention.

Referring first to the very diagrammatic view in FIG. 1, the invention concerns apparatuses comprising at least one inflatable enclosure 1 delimited by at least one accessory 3 secured to said flexible wall 2 of the enclosure. In such apparatuses, the invention proposes that:

- the flexible wall 2 of the enclosure has an opening 4 defined by an edge, and a protruding reinforcement (or bead) 5 is secured to the edge of the opening 4 on the circumference thereof;
- two substantially rigid frames 6, 7 are designed substantially corresponding with the abovementioned edge of the opening 4 in order to straddle the latter and are each arranged on a respective side of the flexible wall 2 (outer or upper frame 6 and inner or lower frame 7 respectively), at least one of these frames comprising a groove 8 able to at least partially accommodate the abovementioned reinforcement 5;
- clamping means 9 (symbolized by a screw shaft in FIG. 1, but other examples are conceivable, as indicated below) are attached to at least the two frames 6, 7 in order to clamp the two frames against one another, trapping said reinforcement 5 in the groove 8;
- securing means (not symbolized in FIG. 1) secure the accessory 3 to one of the frames 6, 7; and
- leakproofing means 10 ensure that the accessory 3 mounted on the flexible wall 2 is leaktight with respect to the fluid used for inflating the enclosure 1.

In a manner which is both simple and effective, the means 10 for ensuring leaktightness with respect to the inflating fluid can be designed in such a way as to totally isolate, from the rest of the enclosure 1, that zone of the wall 2 in which the accessory 3 is mounted. For this purpose, the leakproofing means can comprise a sheet of flexible material (particularly of the same nature and with the same characteristics as the material of the wall 2) forming a flexible bag 10 which is secured in a leaktight manner on its perimeter at 10*a* (in particular by adhesive bonding or welding) to the inner face of the flexible wall 2 around the opening 4, said bag 10 then extending inside the enclosure 1 and surrounding, in a leaktight manner, the accessory 3 and the parts fitting the latter on the wall 2.

The two frames 6 and 7 are preferably provided with respective grooves 8 situated opposite one another and together defining a retaining channel able to accommodate said reinforcement 5, which is thus retained symmetrically. The presence of the reinforcement or bead 5 means that it is possible to take up, about the whole circumference of the opening 4, the tension forces of the wall 2, so that the enclosure does not experience any weakening or any deformation and retains its general shape despite the presence of the accessory.

In a preferred embodiment, the clamping means are screws or bolts (reference number 9 designating the shafts of these) distributed about the circumference of the opening 4. However, it is also possible to imagine the clamping means being formed simply by the edge 2*a* of the opening 4, the outer frame 6 and the inner frame 7 being adhesively bonded and/or welded to one another (reference number 2*a* designating the peripheral part of the wall 2 which is clamped between the two frames 6, 7 and is bordered by the bead 5).

It will be appreciated that the provisions according to the invention which have just been set out are generally applicable to all types of apparatuses in question, both as regards the characteristics of the inflatable enclosure (pneumatically inflatable enclosure, hydraulically inflatable enclosure) and as regards the type of accessory and its use, and also as regards the field of application of said apparatuses.

The invention will now be described in still more detail using a number of specific (but not exclusive) examples of apparatuses belonging to different fields and/or of different accessories.

Figure 2:
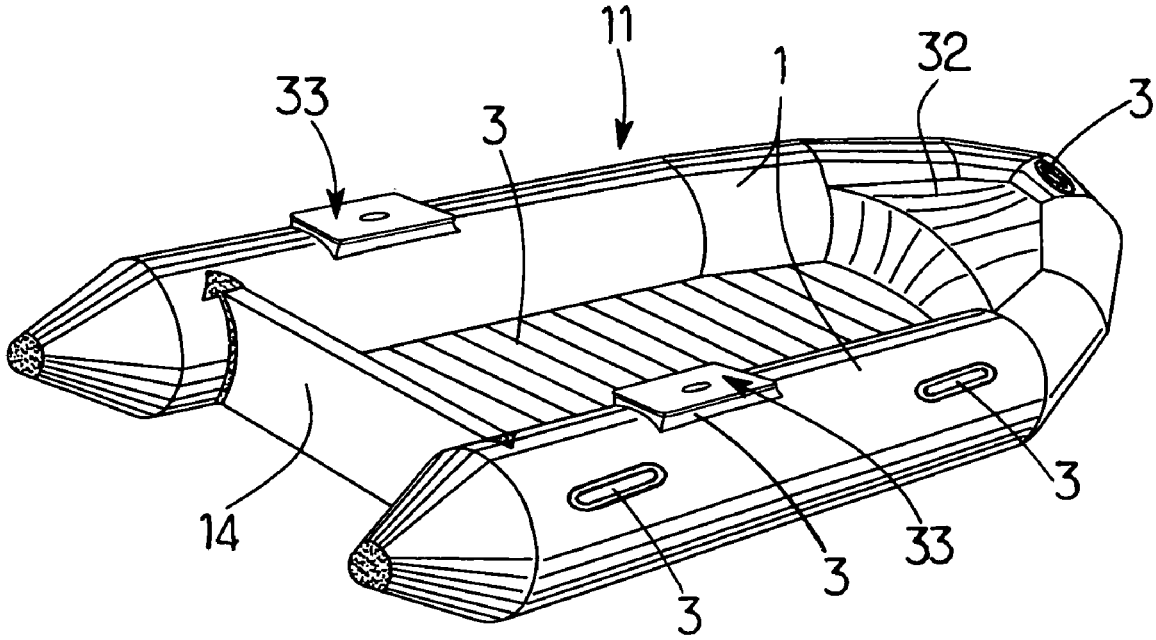
FIG. 2 is a simplified overall perspective view of a pneumatically inflatable boat designed according to the invention.

We will first consider the field of pneumatically inflatable boats, since it is in this field that the provisions of the invention appear to apply preferably, although not exclusively. FIG. 2 shows an example of a pneumatically inflatable boat 11 that may be covered by the invention. The boat 11 is a pneumatically inflatable boat comprising two pneumatically inflatable floats 1 along both sides of a floor 13 and an underlying hull (not shown). The rear part of the boat is closed by a stern board 14 which is secured to the floor 13 and to the floats 1 and which braces these floats 1. The two floats 1 join at the front to form a stem. In the example shown, each float 1 is formed by a pneumatically inflatable tube. Each float 1 (or each tube forming it) represents the inflatable enclosure mentioned above with reference to FIG. 1. The precise type of boat (flexible hull, rigid hull, equipment) does not come into consideration in the context of the invention.

Boats, and in particular inflatable boats, are equipped with traditional accessories such as handgrips for carrying, cleats for mooring lines, and others, which are fixed (adhesively bonded, welded, bolted) in a protruding position on the float. The provisions according to the invention not only permit these accessories to be fitted on the wall of the float 1 in their usual position, that is to say protruding from the float, but also permit fitting these accessories in a novel way, namely fitting them so that they are partially or completely recessed and/or retractable.

Figure 3A:
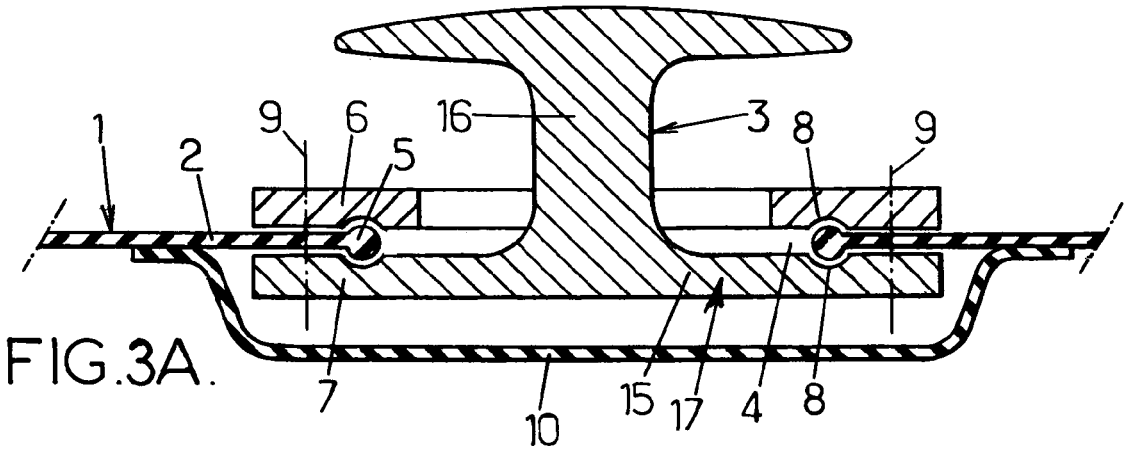
FIGS. 3A and 3B are cross-sectional views illustrating two variants of a first embodiment of the design from FIG. 1 respectively.

Thus, in one possible embodiment illustrated in FIG. 3A, a substantially rigid mounting base 15 is provided for fitting the accessory 3 (for example a handgrip or cleat), which base 15 extends at least partially inside the enclosure 1 (that is to say below the level of the wall 2) and is equipped with a circumferential shoulder constituting the abovementioned inner frame 7. In the example in FIG. 3A, the mounting base 15 and the shoulder forming the inner frame 7 are situated in the continuation of one another and together they have an overall form of a plate 17 equipped with the circumferential groove 8. In the example in FIG. 3A, it has additionally been assumed that the plate 17 formed by the base 15 and the lower frame 7 was made of the same material as the accessory 3 (illustrated here in the form of a cleat): in this case the plate 17 and the functional part 16 of the accessory 3 can be made integral, as is illustrated in FIG. 3A.

Figure 3B:
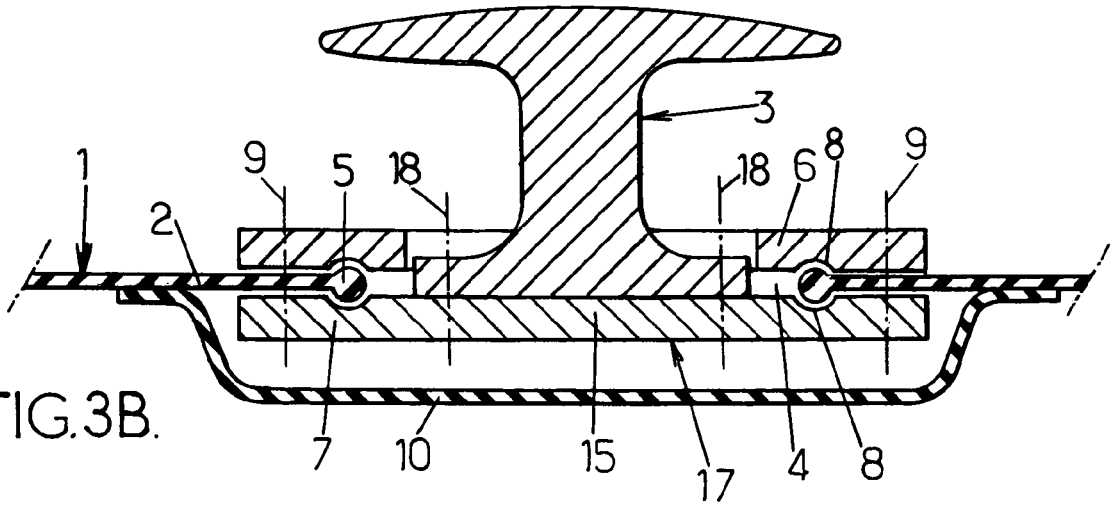

By contrast, in cases where one wishes to use a standard accessory 3 available on the market and/or in cases where the plate 17 and the accessory 3 are not made of the same material (for example the plate 17 is made of a synthetic material and the accessory 3 is made of metal), the accessory 3 (for example the cleat) is placed on the plate 17 and fixed (for example by screwing at 18) onto the latter, as is illustrated in FIG. 3B.

Figure 4A:
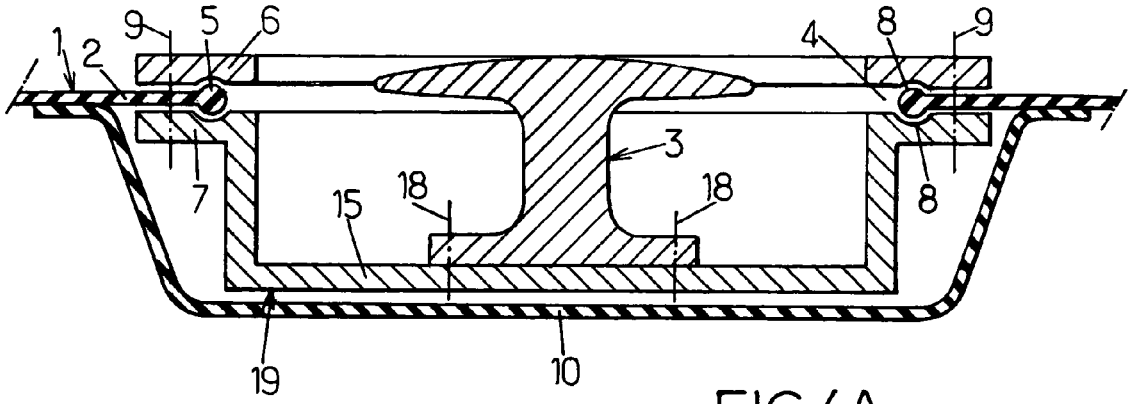
FIGS. 4A, 4B and 4C are cross-sectional views illustrating three variants of a second preferred embodiment of the design from FIG. 1 respectively.

According to a preferred variant illustrated in FIG. 4A, the mounting base 15 can be designed substantially in the form of an open box surrounded by a circumferential shoulder constituting the abovementioned inner frame 7 (the box being designated overall by reference number 19). The accessory 3 is then fixed on the base 15 (for example by screwing 18). In an arrangement as shown in FIG. 4A, the accessory 3 is recessed partially or completely (case illustrated in FIG. 4A) so that there is no longer a risk of the accessory proving dangerous and, moreover, the float 1 has a continuity of line affording an attractive appearance.

Figure 4B:
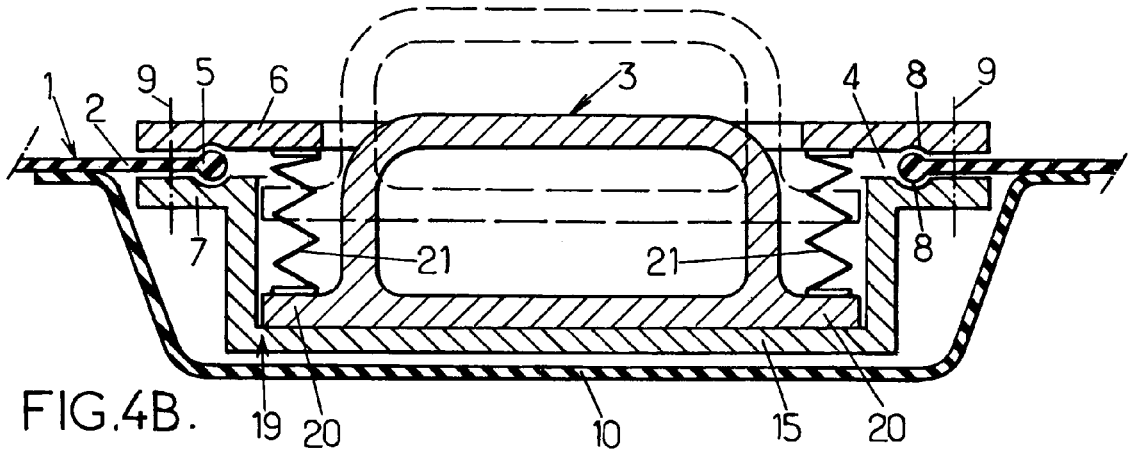

The fixed mounting of the accessory 3 inside the box 19 may be suitable for some accessories such as a cleat, as is shown in FIG. 4A. By contrast, for other accessories such as a handgrip, the box 19 would have to be given substantial dimensions in order to maintain the functionality of the accessory (for example to leave enough free space for taking hold of the handgrip). In such a case, the provisions according to the invention offer the possibility of using a partially or completely retractable accessory. The example illustrated in FIG. 4B concerns a retractable handgrip, which handgrip thus constitutes the accessory 3. The upper frame 6, in particular at its ends, extends inwards beyond the lower frame 7 and partially juts out above the box 19, while the handgrip 3 has, at its base, a flange 20 jutting out at the ends; springs 21 are interposed between the jutting-out part of the upper frame 6 and the jutting-out part of the flange 20, in such a way as to push the handgrip 3 elastically back onto the base of the box 19. The inner contour of the upper frame 6 is shaped such that it is possible to take hold of the top of the slightly protruding handgrip 3 and pull it upwards when one wishes to use it (position illustrated by broken lines). If appropriate, it is possible to provide means comprising a retractable catch (not shown) for blocking the handgrip in the protruding position.

Figure 4C:
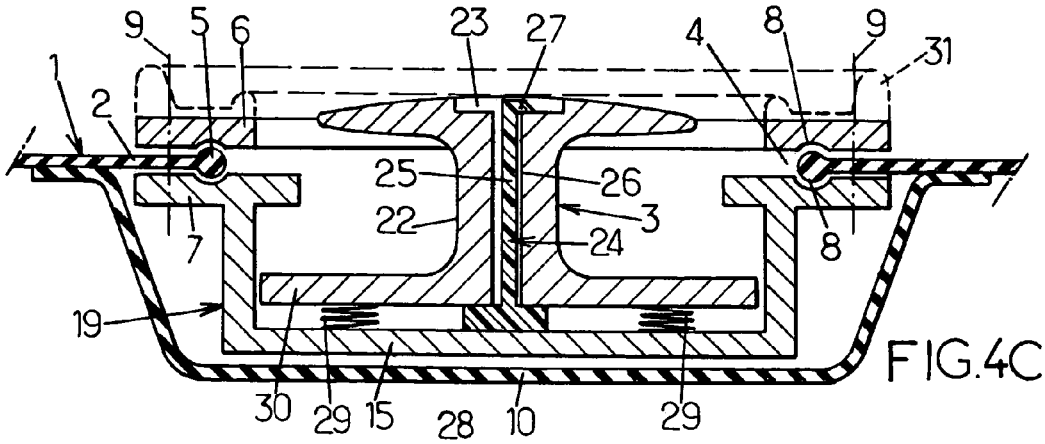

This type of arrangement of a retractable accessory is not reserved to the use of a handgrip and, for example, could be provided for the use of a retractable cleat. The fixed and recessed cleat illustrated in FIG. 4A requires, for its use, that the box 19 is given very large dimensions in order to leave enough space around the cleat to permit winding of a mooring rope or cable around it. FIG. 4C shows an arrangement of a retractable cleat with two stable positions, namely a retracted position and an extended position. For this purpose, the cleat 3 can be provided with a body 22 hollowed out by an axial channel 26 which advantageously opens out, at the top, into a depression or countersink 23 with a flat base. A retention catch 24 comprises an elastic rod 25 passing through the channel 26 and ending at the top in the form of a nose 27. The base part 28 of the rod 25 is made integral with the base 15 of the box 19. Springs 29 are interposed between the flange 30 of the cleat 3 and the base 15. In the recessed position of the cleat illustrated in FIG. 4C, the cleat 3 is driven into the box 19 by compressing the springs 29 and is retained by the nose 27 bearing on the base of the depression 23. When the nose 27 is released, the springs 29 push the cleat 3 back upwards to the extended position or position of use.

The upper frame 6 can advantageously be covered with a decorative cap 31, for example of stainless or chrome steel; or it can be the upper frame 6 itself which, being made for example of moulded synthetic material, has an outer face which presents any desired decorative appearance and may if appropriate have its surface treated with metal (chromium plating).

FIG. 2 is a diagrammatic representation showing the positions of accessories 3 designed according to the invention (for example a retractable cleat on the stem, and two retractable handgrips on the side of each float 1).

In the examples set out above, arrangements of accessories of small size have been more specifically envisaged. However, the provisions of the invention are not limited to the use of such accessories of small size and may also allow the inflatable float 1 to be equipped with accessories of relatively large size. These include the rigid and leaktight compartments of which boat users are in constant need. Traditionally, rigid or flexible compartments have been provided which are installed on the floor and which take up a lot of the space intended for the passengers (in particular flexible compartments at the stem, as is illustrated at 32 in FIG. 2); or compartments arranged in the fixtures (steering console, jockey seat pedestal) specific to certain boats.

According to the invention, provision is made for at least one compartment 33, then constituting the aforementioned accessory 3, to be installed in at least one of the inflatable tubes constituting the floats 1, thereby utilizing a fraction of the internal space of the inflatable tube without however undermining the buoyancy characteristics.

In FIG. 2, a compartment 33 is installed, by way of example, in each of the inflatable tubes or floats 1.

Figure 5:
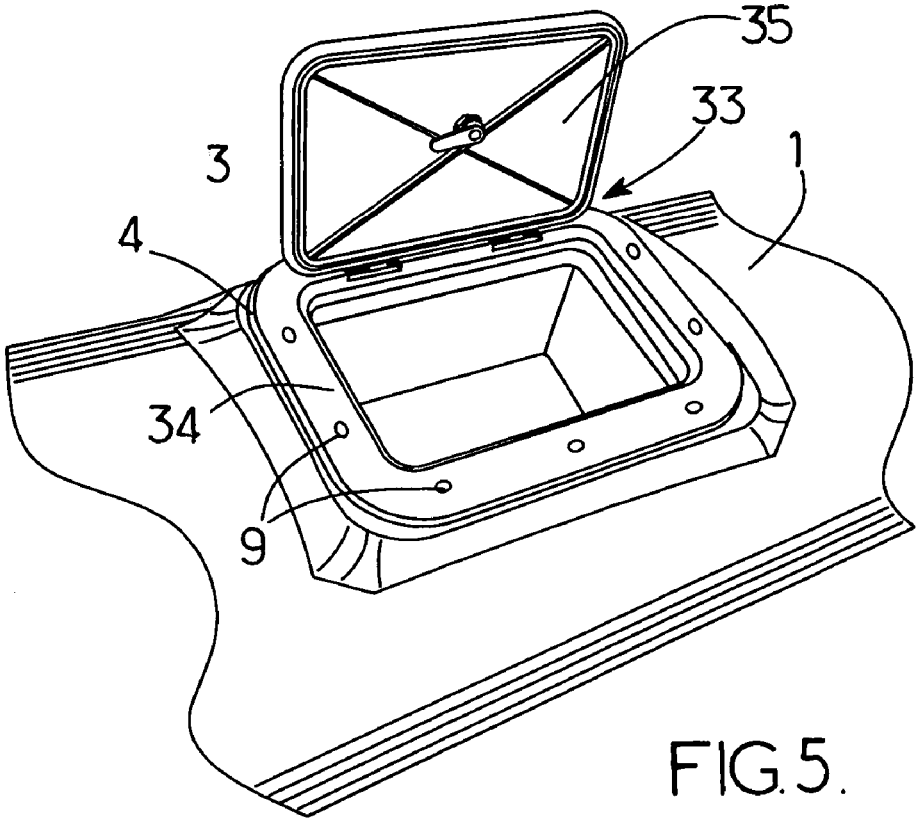
FIG. 5 is a perspective view, on a larger scale, of part of the boat from FIG. 2, showing a compartment installed according to the invention.
Figure 6:
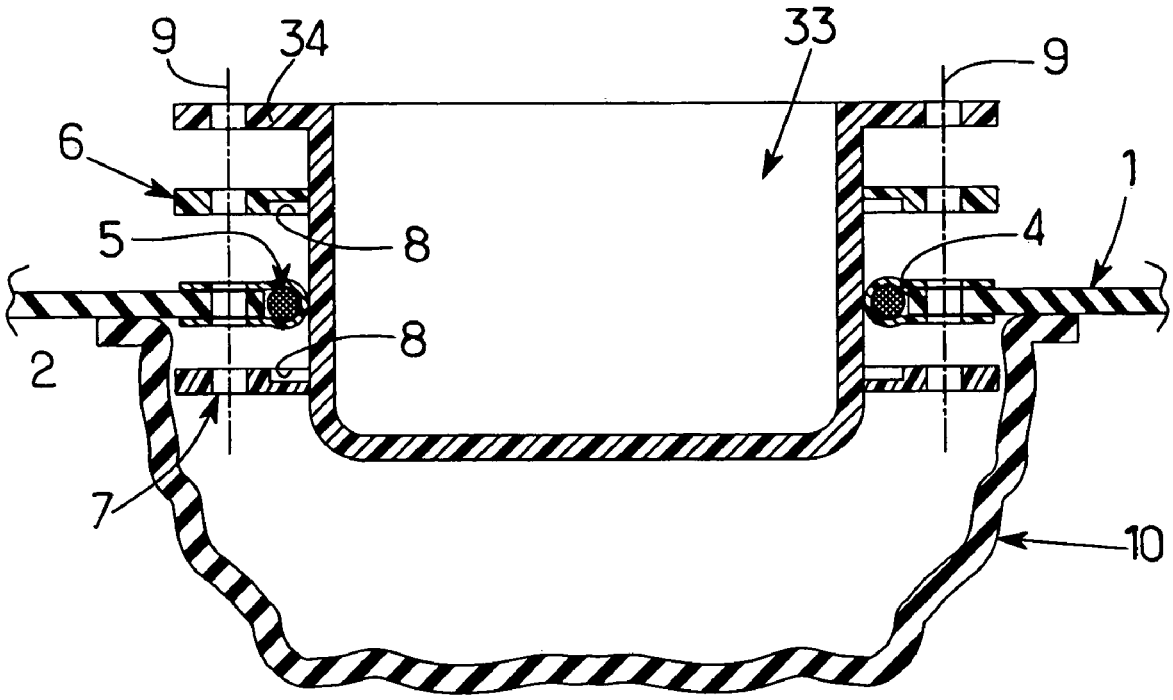
FIG. 6 is an exploded cross-sectional view showing a third embodiment of the design from FIG. 1, together with the compartment from FIG. 5.

As can be seen better from the enlarged view in FIG. 5 and from the exploded cross-sectional view in FIG. 6, the tube 1 comprises an opening 4 on the edge of which the compartment 33 of rigid design (for example of plastic material) is fixed in a leaktight manner. For this purpose, the compartment 33 has a circumferential edge which coincides very closely with the edge of the opening 4 of the inflatable tube 1, the compartment being engaged for the most part, via the opening 4, inside the inflatable tube. The circumferential edge of the compartment 33 is secured by fixing means to said edge of the opening 4 about the entire circumference thereof.

As will be seen from the exploded cross-sectional view in FIG. 6, the leakproofing means are formed as explained above and comprise a flexible bag 10 secured in a leaktight manner (adhesive bonding, welding) to the inner face of the wall 2 of the inflatable tube 1 about the entire circumference of the opening 4.

In a preferred embodiment which is illustrated in FIGS. 5 and 6, the compartment 33 has a substantially rigid shoulder 34 surrounding its circumferential edge and protruding outwards. The shoulder 34 thus covers the edge of the opening 4 on the outer face of the wall 2 of the inflatable tube 1.

As in the preceding examples, a lower rigid frame 7 is provided which has substantially the same shapes and dimensions as the abovementioned shoulder 34 of the compartment 33 and is arranged inside the inflatable tube 1, against the inner face of the wall 2 of the latter and opposite the shoulder 34 of the compartment 33. The shoulder 34 of the compartment could thus constitute the outer frame 6 mentioned above, the compartment 33 then being joined to the flexible wall 2 by clamping of the lower frame 7 and of the shoulder 9.

However, according to an advantageous alternative embodiment, a second frame 6 is provided outside the inflatable tube 1 and interposed between the outer face of the wall 2 of said inflatable tube 1 and the shoulder 34 of the compartment 33.

As before, the compartment 33 is joined to the flexible wall 2 preferably by bolting or screwing at 9 through the shoulder 34, the optional additional outer frame 6, the flexible wall 2 and the inner frame 7. In the case of screws, the holes of the inner frame 7 can be threaded to receive the ends of these screws 13.

Of course, the compartment 33 can be equipped with a suitable lid 35: removable, sliding or preferably pivoting, as is illustrated in FIG. 5. This lid 35 is of any required design as regards the leaktightness of its closure by a peripheral seal, its means of closure by a lock, etc.

In the embodiment illustrated in FIG. 5, the compartment 33 is designed simply with a shoulder 34 which is substantially plane; the inner frame 7 and optionally outer frame 6 are then substantially plane too. The general curvature of the wall of the inflatable tube 1 results in unequal tensions of this wall about the circumference of the opening 4. In any event, the shoulder 34 of the compartment 33 extends approximately in a tangent plane of the inflatable tube 1 and the result of this is that its edges parallel to the axis of the tube 1 are raised in relation to the tube. Such an arrangement may be considered aesthetically unattractive.

Figure 7A:
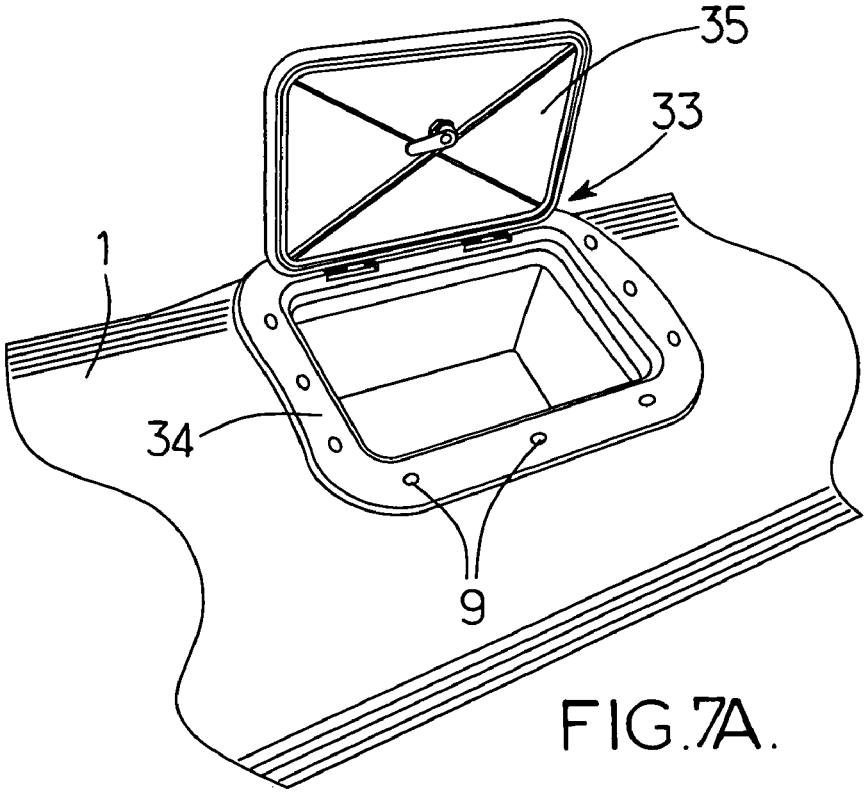
FIGS. 7A and 7B show two variant embodiments of the design from FIG. 5 respectively.

To avoid these protrusions, use may be made of the arrangement illustrated in FIG. 7A in which the two parts of the shoulder 34 extending transversely with respect to the tube 1 are curved so as to match the curvature of the tube 1. The inner and optionally outer frames and the lid are themselves curved in the same way. A compartment is thus produced whose visible part integrates perfectly, in visual terms, in the general configuration of the inflatable tube 1.

Figure 7B:
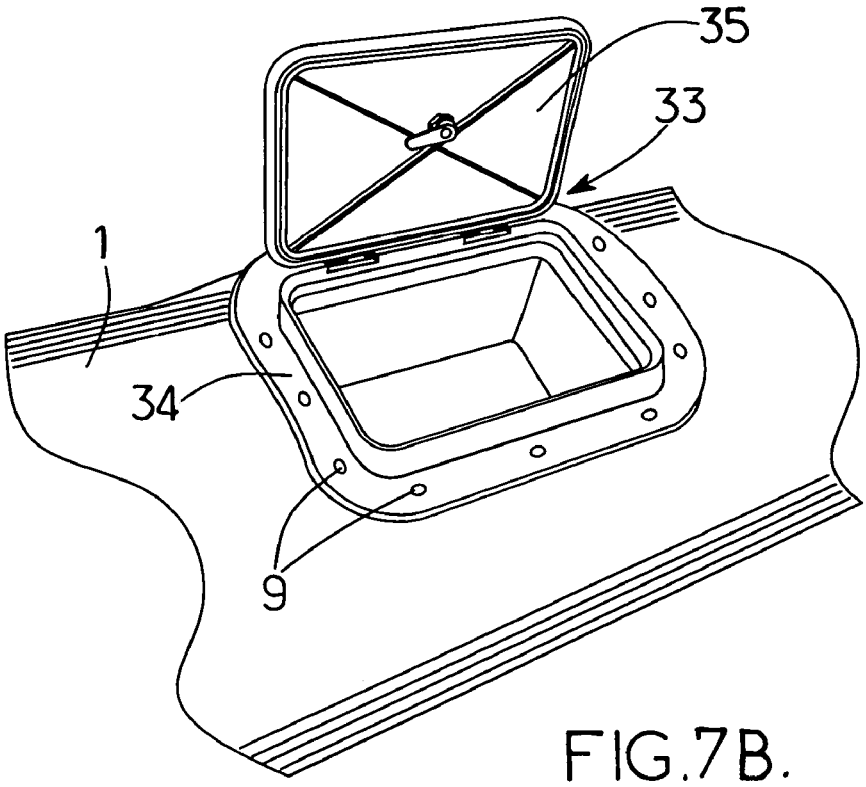

If appropriate, use may be made of an intermediate solution illustrated in FIG. 7B, according to which the shoulder 34 and the inner frame 7 and optionally outer frame 6 are curved in order to match the curvature of the inflatable tube 1 in the same way as in the embodiment in FIG. 7A, whereas the lid 35 remains flat, as in the embodiment in FIG. 5. In this arrangement, the upper part of the compartment 33 with the lid 35 admittedly remains slightly protruding above the curved face of the tube 1, but the curvature of the shoulder 34 and of the other components of the fixing means makes it possible to eliminate the inequality of tension of the wall of the tube 1 around the opening 4.

Figure 8A:
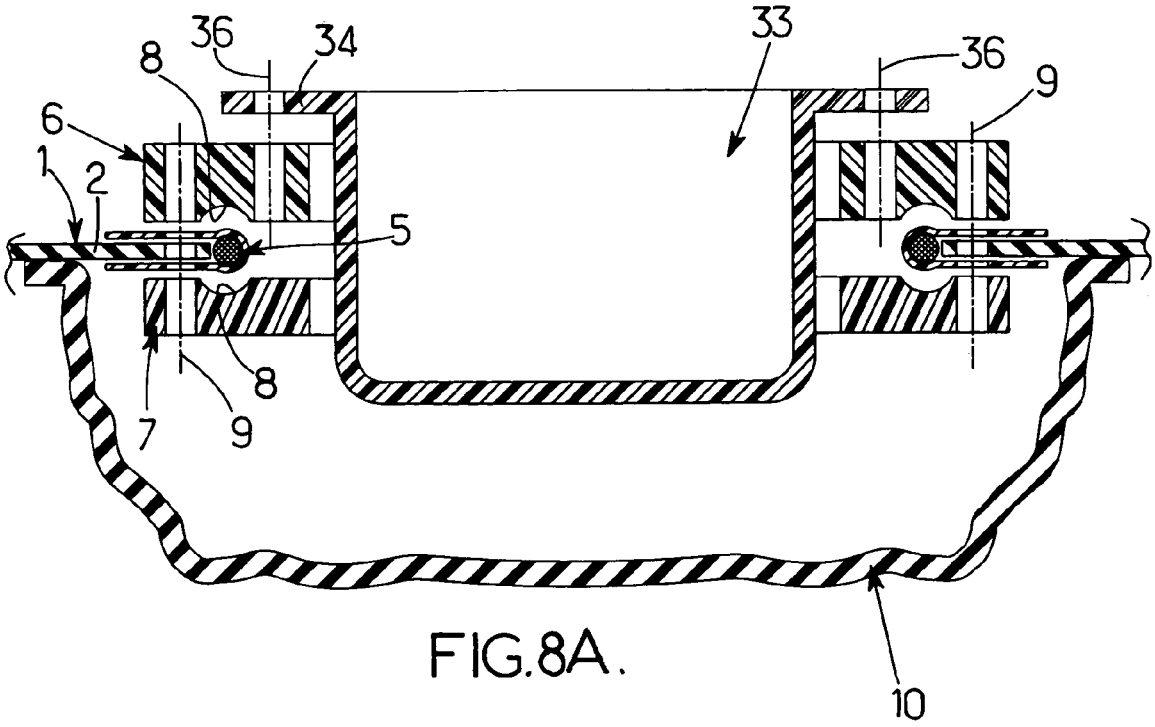
FIGS. 8A and 8B are exploded cross-sectional views of two variants of another embodiment of the mounting from FIG. 5 respectively.

FIG. 8A is an exploded cross-sectional view illustrating another embodiment of the provisions in FIG. 5. The two frames, inner frame 7 and outer frame 6, are provided with respective grooves 8 able to enclose the reinforcement 5 forming a retention bead secured to the wall 2 of the inflatable tube 1. The two frames 6 and 7 are secured, enclosing said wall 2 of the inflatable tube 1, with the aid of first fixing means, for example screws or bolts 9 (symbolized by their axes), distributed about the reinforcement 5.

By virtue of the provisions according to the invention, a storage space is obtained which is perfectly integrated in the basic structure of the boat, does not affect said structure, can thus be used whatever the configuration of the boat, and does not take up any of the space inside the boat. What is more, the leakproofing means used ensure particularly effective protection of the inflatable tube, and the presence of the compartment does not in any way affect the buoyancy characteristics.

The compartment 33 then has its upper shoulder 34, which rests on the upper frame 6, secured only to this frame 6, with the aid of second fixing means such as screws or bolts 36 which, in this example of use, extend parallel to the aforementioned screws or bolts 9.

This arrangement has the advantage of permitting easy dismantling of the compartment, whereas, in the arrangement in FIG. 6, such dismantling was made more complex by the fact that the same fixing member (bolt, screw) was used both for fixing the compartment on the upper frame and for fixing the two frames on the wall of the inflatable tube.

Figure 8B:
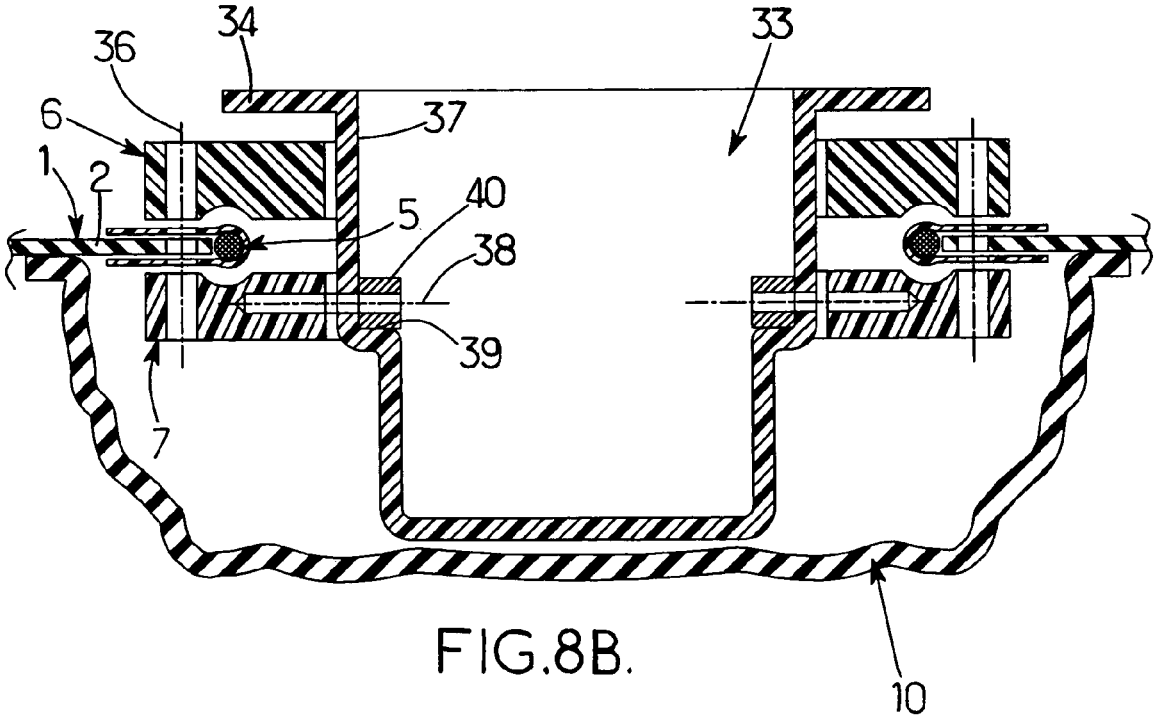

FIG. 8B illustrates a variant of the preceding embodiment. Here, the compartment 33 is no longer fixed by securing its shoulder 34 to the outer frame 6, but is instead fixed by securing the lateral wall 37 of the compartment to one of the frames 6, 7, for example to the inner frame 7, with the aid of screws 38 extending perpendicular to the screws 8 joining the two frames 6, 7 to the wall 2 of the inflatable tube 1, as is shown in FIG. 8B.

In addition, in order to reinforce the compartment 33, the lateral wall 37 thereof has an upper part with a greater transverse dimension than that of the lower part, so as to form a ledge 39 which can extend about the circumference of the compartment or, alternatively, only on two opposite faces. In addition, the head of each screw 38 bears on a support piece 4.0, with either a support piece 40 being provided for each screw 38 or a single support piece 40 being provided, matching the inner contour of the compartment 33 and bearing against the ledge 39, this single support piece 40 forming an internal peripheral reinforcement of the compartment.

The arrangements illustrated in FIGS. 8A and 8B permit easy and rapid dismantling/reassembly of the compartment 33 while at the same time ensuring good tensioning of the sheet of material (for example laminated fabric) constituting the wall 2 of the inflatable tube 1, by virtue of the reinforcement 5 forming a bead which is trapped in the channel defined by the two grooves 8 of the joined frames 6, 7.

Another field of application of the provisions of the invention concerns inflatable swimming pools. An example of such a swimming pool, designated overall by reference number 41, is illustrated in FIG. 9. The swimming pool 41 is delimited circumferentially by an inflatable pneumatic tube 1 of large volume which occupies the full height of the swimming pool and which, at the bottom, is secured in a leaktight manner to a base (not shown). The inflatable tube 1 can extend in a closed contour, especially a round contour (as illustrated) or an oval contour, in order to retain a volume of water 42. Given the large volume of the inflatable tube 1 (which here constitutes the inflatable enclosure 1 mentioned above) and its relatively large cross section, it is possible to equip it with a compartment 33 of rigid structure under the same conditions as those set out above for equipping an inflatable buoyancy tube of a pneumatically inflatable boat.

The compartment 33 (which thus constitutes the aforementioned accessory designated generically by 3) can be formed as has been indicated above, and it can be secured to the inflatable tube in the manner set out with reference to FIG. 6, 8A or 8B and make use of the configurations of implantation on the tube which are illustrated in FIGS. 5, 7A and 7B.

As regards more specifically the fixing of the compartment 33 to the inflatable tube 1, it will be noted that it is possible to use other means, such as adhesive bonding and/or welding, given the less stringent conditions of use than in the case of pneumatically inflatable boats and given the lower tension forces to which the material constituting the inflatable tube is subjected.

Of course, the compartment 33 will be able to be designed, particularly on the inside, in any desirable way appropriate to a possible specific use. Thus, in the case of equipping a pneumatically inflatable boat, the compartment can be provided on the inside with fixing and/or partitioning means suitable for the storage of navigation equipment. Likewise, in the case of equipping a swimming pool, the compartment can be designed for the storage of floating articles and/or toys which thus remain accessible from the water. In all cases, and in particular when equipping a swimming pool, it is possible to envisage the compartment being in the form of an icebox, with the advantage that, because most of it is engaged inside the inflatable tube, the compartment is better protected from the sun.

FIG. 10 illustrates yet another field of application of the provisions of the invention which concerns flexible reservoirs for liquids (water, fuel, etc.). Here, it is the closed bag with flexible wall which constitutes the inflatable enclosure mentioned above, the inflation of this enclosure being of the hydraulic type and being triggered by the liquid introduced into the enclosure. The flexible reservoir 43 comprises a flexible enclosure 1, of any desired shape, which can be equipped with a compartment 33 under the same conditions as those set out above for equipping an inflatable buoyancy tube of a pneumatically inflatable boat. The compartment 33 can be secured to the flexible wall 2 of the enclosure 1, particularly to the top face thereof, in the manner set out above with reference to FIGS. 6, 8A and 8B. Such a compartment 33 can be used to receive the equipment necessary for utilizing the reservoir 43, for example for actuating a valve 44 controlling the introduction of the liquid into the bag or its extraction from the bag, or alternatively it can be used to accommodate control equipment (pressure gauge, temperature gauge, filling level gauge) needed for utilizing the reservoir.

It will be appreciated, from the examples given above, that the invention can be applied in numerous fields for equipping various inflatable enclosures.

What is claimed is:

1. Apparatus comprising at least one inflatable enclosure delimited by at least one flexible wall and at least one accessory mounted on said flexible wall of the enclosure and supported thereby, in which:

the flexible wall of said inflatable enclosure has an opening defined by an edge, and a protruding reinforcement is secured to the edge of the opening on the circumference thereof, two substantially rigid frames are designed substantially corresponding with the edge of the opening in order to straddle the latter and are each arranged on a respective side of the flexible wall so as to form an outer frame and an inner frame respectively, at least one of these frames comprising a groove able to at least partially accommodate the reinforcement, clamping means are attached to at least the two frames in order to clamp the two frames against one another, trapping said reinforcement in the groove, and securing means secure the accessory to one of the frames, wherein leakproofing means are provided inside the enclosure around the opening and the accessory so as to ensure that the accessory mounted on the flexible wall is leaktight with respect to the fluid used for inflating the enclosure.

2. Apparatus according to claim 1, wherein said leakproofing means comprise a flexible bag made of a leaktight material and secured in a leaktight manner to the inner face of the wall of the inflatable enclosure around the opening, said bag extending inside the inflatable enclosure and surrounding the accessory in a leaktight manner.

3. Apparatus according to claim 1, wherein said two frames comprise two respective grooves situated opposite one another and together defining a retaining channel able to accommodate said reinforcement.

4. Apparatus according to claim 1, wherein said clamping means are screws or bolts distributed about the circumference of the opening.

5. Apparatus according to claim 1, wherein said wall bordering the opening, said inner frame and said outer frame are secured by adhesive bonding, welding, or both.

6. Apparatus according to claim 1, wherein a substantially rigid base is provided for mounting the accessory, which base extends at least partially inside the enclosure and is equipped with a peripheral shoulder constituting the inner frame.

7. Apparatus according to claim 6, wherein said base is substantially in the form of a plate.

8. Apparatus according to claim 6, wherein said base is substantially in the form of an open box.

9. Apparatus according to claim 8, wherein the accessory is designed to be retractable, at least partially, inside the box.

10. Apparatus according to claim 6, wherein the accessory comprises a functional part which is integral with the base.

11. Apparatus according to claim 6, wherein the accessory comprises a functional part which is applied on the base and fixed thereto.

12. Apparatus according to claim 6, wherein said outer frame is equipped with or covered on the outside with a decorative cap.

13. Apparatus according to claim 1, wherein said accessory is a substantially rigid compartment which extends at least partially inside said inflatable enclosure and which comprises a substantially rigid shoulder protruding transversely with respect to the wall of the compartment and situated outside the wall of the enclosure.

14. Apparatus according to claim 13, wherein said shoulder of the compartment constitutes the outer frame.

15. Apparatus according to claim 13, wherein said shoulder of the compartment is independent of said outer frame and covers the latter.

16. Apparatus according to claim 15, wherein said clamping means are screws or bolts distributed about the circumference of the opening and wherein said shoulder of the compartment is fixed by said clamping means.

17. Apparatus according to claim 15, wherein said clamping means are screws or bolts distributed about the circumference of the opening and wherein said compartment is secured to only one of the two frames by second fixing means distinct from said clamping means.

18. Apparatus according to claim 17, wherein said lateral wall of the compartment has a ledge, and wherein said second fixing means comprise screws or bolts passing through said lateral wall of the compartment and engaged with one of the inner or outer frames, the heads of these screws or bolts bearing on a support piece resting against the ledge.

19. Apparatus according to claim 18, wherein said support piece is unique and in the form of a frame matching the inner peripheral contour of the compartment in order to reinforce the latter.

20. Apparatus according to claim 13, wherein said shoulder of the compartment, said inner frame and said outer frame are substantially plane.

21. Apparatus according to claim 13, wherein said shoulder of the compartment, said inner frame and said outer frame are curved substantially to match the curvature of the flexible wall of the inflatable enclosure.

22. Apparatus according to claim 1 having a flank and in which the at least one inflatable enclosure comprises at least one pneumatically inflatable tube forming at least part of the flank.

23. Apparatus according to claim 1 in the form of a pneumatically inflatable boat, in which the at least one inflatable enclosure comprises a plurality of lateral pneumatically inflatable tubes joined at the front to form a stem, and further comprising a stem board and a rigid floor bracing the plurality of pneumatically inflatable tubes.

24. Apparatus according to claim 1 in the form of an inflatable swimming pool and in which the at least one inflatable enclosure comprises at least one pneumatically inflatable tube circumferentially delineated by the at least one flexible wall.

* * * * *